US009808105B2

(12) United States Patent
Pidwell et al.

(10) Patent No.: US 9,808,105 B2
(45) Date of Patent: Nov. 7, 2017

(54) CARRYING CASE

(71) Applicant: VS VEREINIGTE SPEZIALMOEBELFABRIKEN GMBH & CO. KG, Tauberbischofsheim (DE)

(72) Inventors: Jonathan Pidwell, Tauberbischofsheim (DE); Linda Tegeler, Wuerzburg (DE)

(73) Assignee: VS Vereinigte Spezialmoebelfabriken GmbH & Co. KG, Tauberbischofsheim (DE)

( * ) Notice: Subject to any disclaimer, the term of this patent is extended or adjusted under 35 U.S.C. 154(b) by 114 days.

(21) Appl. No.: 14/802,048

(22) Filed: Jul. 17, 2015

(65) Prior Publication Data

US 2016/0100706 A1 Apr. 14, 2016

(30) Foreign Application Priority Data

Oct. 13, 2014 (DE) ..... 10 2014 220 704

(51) Int. Cl.

| | |
|---|---|
| ***A47G 29/08*** | (2006.01) |
| ***A45F 5/00*** | (2006.01) |
| ***A45F 5/12*** | (2006.01) |
| ***A45C 3/02*** | (2006.01) |
| ***A45C 5/04*** | (2006.01) |

(Continued)

(52) U.S. Cl.

CPC ..... *A47G 29/083* (2013.01); *A45C 3/02* (2013.01); *A45C 5/045* (2013.01); *A45C 11/00* (2013.01); *A45C 13/04* (2013.01); *A45C 13/30* (2013.01); *A45C 13/36* (2013.01); *A45F 5/00* (2013.01); *A45F 5/12* (2013.01); *B43M 2017/00* (2013.01)

(58) Field of Classification Search

CPC ..... A47G 29/083; A45C 11/00; A45C 13/30; A45C 13/36

USPC ..... 220/475; 224/420

See application file for complete search history.

(56) References Cited

U.S. PATENT DOCUMENTS 606,796 A * 7/1898 Ufford ..... B62J 9/00 224/420
1,211,165 A * 1/1917 Kaufmann ..... A45C 13/36 190/37

(Continued)

FOREIGN PATENT DOCUMENTS

CA 2587069 A1 11/2008
CN 2486438 Y 4/2002

(Continued)

*Primary Examiner* — Stephen Castellano

(74) *Attorney, Agent, or Firm* — Laurence A. Greenberg; Werner H. Stemer; Ralph E. Locher

(57) ABSTRACT

A carrying case for storing items in a work environment includes a bag element for accommodating items having an access opening at the upper side when the bag element is in its position of use, and a dimensionally stable support frame to which an upper edge region of the bag element in the bag element's position of use is fixed in such a way that the access opening of the bag element is accessible through the support frame. A dimensionally stable holding bracket having a first projection and a second projection is provided on the support frame, permitting the carrying case to be hung from a board-like furniture element in such a way that the first projection makes contact with an upper side of the furniture element and the second projection makes contact with an underside of the furniture element.

12 Claims, 2 Drawing Sheets

(51) Int. Cl.

| | |
|---|---|
| ***A45C 13/04*** | (2006.01) |
| ***A45C 13/36*** | (2006.01) |
| ***A45C 11/00*** | (2006.01) |
| ***A45C 13/30*** | (2006.01) |

(56) References Cited

U.S. PATENT DOCUMENTS

| | | | | | |
|---|---|---|---|---|---|
| 1,400,758 | A | * | 12/1921 | Mansfield | B62J 9/003 224/420 |
| 3,396,885 | A | * | 8/1968 | Giondi | B62J 7/00 220/9.1 |
| 4,194,714 | A | | 3/1980 | Schultz | |
| 4,415,105 | A | * | 11/1983 | Jackson | B62J 9/003 224/420 |
| 5,423,509 | A | * | 6/1995 | LaPorte | B62J 11/00 224/414 |
| 2008/0257896 | A1 | | 10/2008 | Guy et al. | |

FOREIGN PATENT DOCUMENTS

| | | | |
|---|---|---|---|
| CN | 202311770 | U | 7/2012 |
| CN | 20286853 | U | 4/2013 |
| DE | 102008018769 | A1 | 10/2009 |
| DE | 102009040875 | A1 | 3/2011 |
| JP | 4891457 | B1 | 3/2012 |
| KR | 20120003747 | U | 5/2012 |
| TW | M345753 | U | 12/2008 |
| WO | 2008134863 | A1 | 11/2008 |

* cited by examiner

CARRYING CASE

CROSS-REFERENCE TO RELATED APPLICATION

This application claims the priority, under 35 U.S.C. §119, of German Patent Application DE 10 2014 220 704.5, filed Oct. 13, 2014; the prior application is herewith incorporated by reference in its entirety.

BACKGROUND OF THE INVENTION

Technical Field

The present invention relates to a carrying case, particularly a carrying case for storing items in a work environment.

Related Art

In a work environment in which the actual workplace changes and/or where multiple people use the same workplace such as, for example, offices, schools, workshops, field service, etc., it has proven advantageous for each worker to keep their personal work materials (e.g. notebook, documents, office materials, tools, etc.) in their own storage unit, to take that unit with them to their respective workplace as well as to be able to put it away and preferably lock it up when not in use. In that context, both larger storage units such as rolling containers, etc., as well as smaller storage units such as carrying cases, etc., can be employed.

SUMMARY OF THE INVENTION

It is accordingly an object of the invention to provide an improved carrying case for personal work materials, which overcomes the hereinafore-mentioned disadvantages of the heretofore-known devices of this general type and which improves the user's comfort at their respective workplace.

With the foregoing and other objects in view there is provided, in accordance with the invention, a carrying case, comprising a bag element for accommodating items having an access opening at the upper side when the bag element is in its position of use and a dimensionally stable support frame to which an upper edge region of the bag element in the bag element's position of use is fixed in such a way that the access opening of the bag element is accessible through the support frame. A dimensionally stable holding bracket having a first projection and a second projection is provided on the support frame, through the use of which the carrying case can be hung from a board-like furniture element in such a way that the first projection makes contact with an upper side of the furniture element and the second projection makes contact with an underside of the furniture element.

The dimensionally stable support frame lends the carrying case overall stability and, together with the holding bracket provided thereon, moreover forms a hanging mechanism for use on a board-like or board-shaped furniture element. Thus, the user can easily and conveniently hang the carrying case from a board-like furniture element at his or her respective workplace without needing any additional auxiliary measures or devices. This thereby improves the user's level of comfort. Due to the storage unit being constructed as a carrying case, the user can also use it in a very flexible and convenient manner. This also improves the user's level of comfort.

The carrying case can be hung on a board-like furniture element by using the holding bracket in such a way that the first projection of the holding bracket makes contact with an upper side of the furniture element and the second projection of the holding bracket makes contact with an underside of the furniture element. In other words, the holding bracket grasps an edge of the board-like furniture element by its two projections. The carrying case can thereby be hung on all board-like furniture elements of a thickness not exceeding a dimension predetermined by the form and the size of the holding bracket. In other words, the carrying case can in particular be hung from furniture elements of different board thicknesses up to a maximum board thickness.

The term "board-like furniture element" in this context encompasses any type of board-like or board-shaped furniture element being a piece of furniture or part of a piece of furniture. Board-like furniture elements on which a carrying case in accordance with the invention can be hung in particular include desk worktops, workbenches and other tables, shelves, top panels of cabinets and racks, etc.

The term "dimensionally stable" in this context refers to the inherent stability of the shape when the carrying case is used as intended. The dimensionally stable components of the carrying case are in particular to be differentiated from flexible components.

The carrying case of the present invention can be advantageously used in numerous work environments. These in particular include, but are not limited to, offices, open-plan offices, workshops, field service activities, educational institutions such as schools, universities, etc. (use e.g. by teacher, student, etc.) and the like.

In accordance with another preferred configuration of the invention, the dimensionally stable holding bracket is integrally formed on or formed in one-piece with the dimensionally stable support frame. Alternatively, the holding bracket can also be constructed as a separate component and fixed to the support frame.

Preferably, the first projection and the second projection of the holding bracket extend outward from the support frame in substantially the same direction and/or the first projection and the second projection of the holding bracket extend substantially parallel to one another. In accordance with a further preferred configuration of the invention, the holding bracket has—when viewed from the side—an approximate C-shape. The second projection thereby preferentially extends at least as far outward from the support frame as, and preferably farther, than the first projection.

In accordance with an added preferred configuration of the invention, the first projection of the holding bracket has a first soft component on its contact side for making contact with the furniture element and/or the second projection of the holding bracket has a second soft component on its contact side for making contact with the furniture element. The soft components serve in keeping the carrying case from slipping off of a furniture element, making for a more secure hanging, and also in protecting the furniture element and/or its surface finish. The soft components are preferentially made from a thermoplastic elastomer (TPE). When the holding bracket is made from a plastic material, the soft components are preferentially molded onto the projections of the holding bracket in a 2C injection molding process.

In accordance with an additional preferred configuration of the invention, the support frame and the first projection of the holding bracket extend in substantially the same plane. The first projection of the holding bracket is preferably constructed as a continuation of the holding bracket.

In accordance with yet another preferred configuration of the invention, the holding bracket is provided on one side of the support frame and the support frame is formed with at least one respective shoulder on the two adjoining sides. Thus, on one hand, the carrying case can be hung by the holding bracket on a board-like furniture element at the respective workplace and, on the other hand, slid by using the shoulder on the support frame into a guide rail, for example of a storage cabinet, when not in use. Preferably, such a storage cabinet can be locked or has a plurality of lockers.

In accordance with yet a further preferred configuration of the invention, the bag element is also of dimensionally stable construction. Thus, the entire carrying case as a whole has an inherent stability of shape. The carrying case can then be set down on a floor or on a deposition area if need be. Preferably, with this configuration the bag element has at least one stand on its lower side in the position of use.

In accordance with yet an added preferred configuration of the invention, the bag element is built up from two bag shells.

In accordance with yet an additional preferred configuration of the invention, the bag element is of multilayer construction. The bag element thereby preferably includes a layer of reinforced synthetic felt, preferentially a natural fiber reinforced polypropylene felt and/or a layer of fabric mesh. In addition, the bag element preferably has an outer design layer made, for example, of felt, cloth, leather, plastic or the like.

In accordance with again another preferred configuration of the invention, the carrying case further includes a carrying strap (preferably detachably) fastened to the support frame and/or the bag element. The carrying strap is preferably of length-adjustable construction or is made available to the user in different lengths.

Preferably, this carrying strap wraps around the closed narrow sides of the bag element. In case the bag element is built up from two bag shells, the carrying strap preferably overlaps a connection between the two bag shells.

In accordance with again a further preferred configuration of the invention, the carrying case further includes at least one elastic band wrapping around the bag element. The elastic band allows objects to also be tucked into the outer side of the carrying case if needed.

In accordance with a concomitant preferred configuration of the invention, the carrying case further includes a cover element for closing the access opening of the bag element. This cover element is preferentially insertable into the support frame, preferably removably insertable.

Other features which are considered as characteristic for the invention are set forth in the appended claims.

Although the invention is illustrated and described herein as embodied in a carrying case, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE PREFERRED EMBODIMENTS

Figure 1:
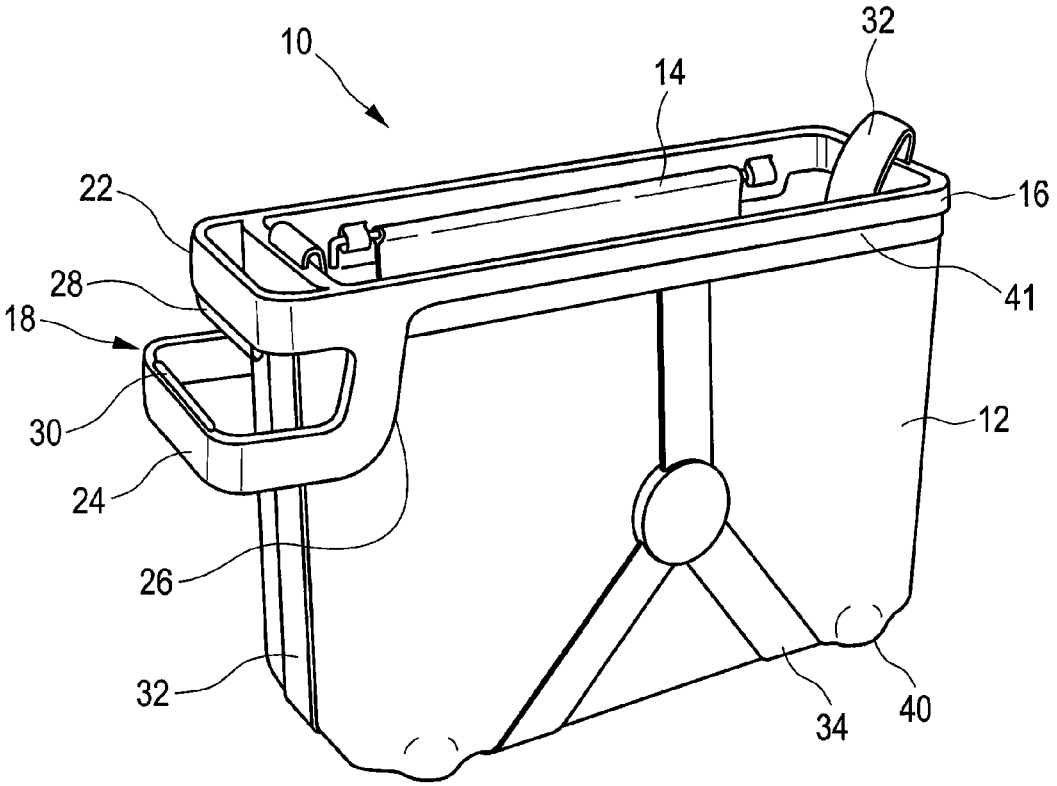
FIG. 1 is a diagrammatic, perspective view of a carrying case according to a preferential embodiment of the invention.
Figure 2:
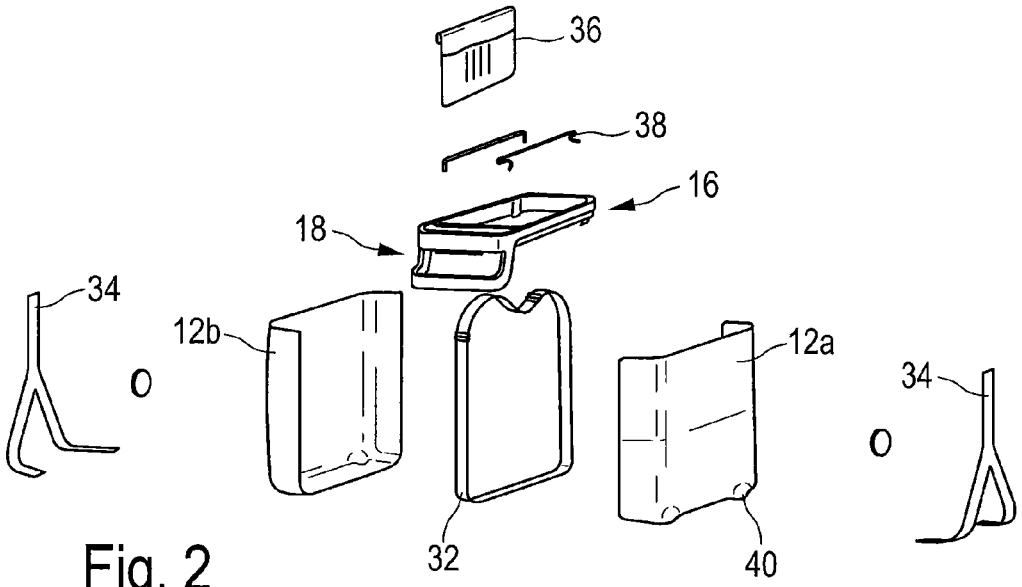
FIG. 2 is an exploded, perspective view of the carrying case of FIG. 1.
Figure 3:
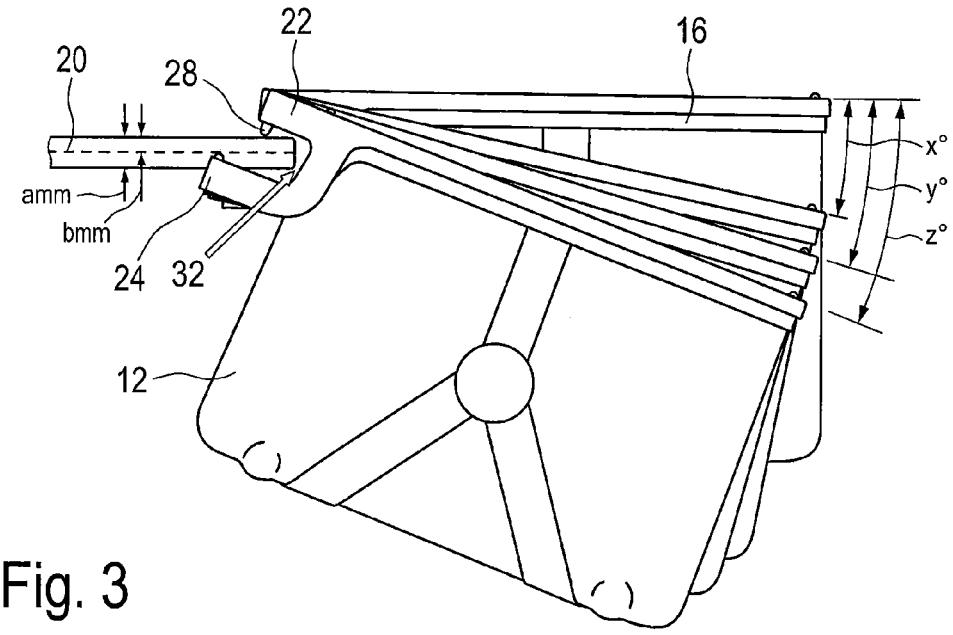
FIG. 3 is a side-elevational view of the carrying case of FIG. 1 when hung on a board-like furniture element.

Referring now to FIGS. 1 to 3, in the following there is exemplarily described a preferred embodiment of a carrying case according to the invention in greater detail.

The carrying case serves to store personal work materials of the user. During the course of his or her work, the user can take it to his or her workplace and hang it there on a board-like furniture element and it can preferably be locked away during the times the user is not working. Thus, the carrying case of the invention is advantageous particularly for work performed at changing workplaces and/or where multiple people use the same workplace at different times. Such work environments are found, for example, in offices, schools, field service, etc.

The carrying case 10 includes a dimensionally stable bag element 12 built up from two dimensionally stable shell elements 12*a*, 12*b* and exhibits an access opening 14 at its upper side when in its position of use. The two shell elements 12*a*, 12*b* are preferably of identical construction. They can be connected together, for example, by a zipper connection or a clamp or press fitting of suitable connecting elements, or the like.

The bag element 12 is, for example, dimensioned in such a way that a slim DIN A4 file folder and/or a 15-inch notebook can be accommodated inside.

The two bag shells 12*a*, 12*b* of the bag element 12 are preferentially of multilayer construction and pressed as a sandwich construction of different materials. They, for example, have a center layer of natural fiber reinforced polypropylene felt (NFPP felt), an inner layer of fabric mesh and an outer cover layer. Among other things, the cover layer serves in the design and is, for example, made from cloth, felt, leather, plastic or the like.

The bag element 12 includes a plurality of stands 40 on its lower side in the position of use so as to be able to set down the carrying case 10 with the bag element 12. The stands 40 are preferably formed integrally or in one-piece with the shell elements 12*a*, 12*b*.

The upper edge region of the bag element 12 in the bag element's position of use, which fully encircles the access opening 14 of the bag element 12, is fixed to a dimensionally stable support frame 16. The access opening 14 of the bag element 12 is thereby freely accessible to the user through the support frame 16. The carrying case 10 can also optionally include a cover element able to be removably inserted into the support frame 16 for closing the access opening 14.

The dimensionally stable support frame 16 lends the carrying case 10 additional stability. To this end, the support frame 16 is, for example, made from an (ultra) strong plastic material, for example in an injection molding process.

Further, a dimensionally stable holding bracket 18 is provided on the support frame 16, preferably formed integrally thereon or in one-piece therewith. This dimensionally stable holding bracket 18 enables the carrying case 10 to be hung on a board-like or board-shaped furniture element 20 such as, for example, the worktop of a desk, a shelf, etc. without the need for any extra additional mechanisms.

As illustrated as an example in FIG. 3, the carrying case 10 can be securely hung from board-like furniture elements 20 of different board thicknesses by using the holding bracket 18. In the embodiment depicted, the holding bracket 18 is dimensioned so as to be able to be hung on board thicknesses up to a maximum of 25 mm (indicated as amm in FIG. 3) yet still remain stably hung even in the case of thinner board thicknesses of only 13 mm (indicated as bmm in FIG. 3).

While the carrying case 10 and its support frame 16 are respectively aligned approximately horizontally when hung from a furniture element 20 of the maximum intended board thickness (in this case: 25 mm), the carrying case 10 is tilted at lesser board thicknesses, for example up to approximately 20° (indicated as angle z°) to the horizontal, as indicated in FIG. 3.

The holding bracket 18 of this embodiment exhibits an approximate C-shape in a side view so as to be able to hang the carrying case 10 on a board-like furniture element 20 in this way. The holding bracket 18 in particular includes an upper substantially straight first projection 22 and a lower substantially straight second projection 24 which extend substantially parallel to one another and extend outward from the support frame 16 in substantially identical directions. The two projections 22, 24 are connected together by a connecting section 26. In this embodiment, the lower second projection 24 extends further outward from the support frame 16 than the upper first projection 22. The two projections 22, 24 having free ends 22', 24' facing away from said support frame and being spaced apart one from another.

For the purpose of providing slip resistance and protection of the surface finish of the furniture element 20, a first soft component 28 is provided on the first projection 22 and a second soft component 30 is provided on the second projection 24. The two soft components are thereby disposed on facing sides of the projections 22, 24 so as to receive the board-like furniture element 20 between them (see FIG. 3). The two soft components are formed, for example, from a thermoplastic elastomer (TPE) and can be molded onto the holding bracket 18, for example in a 2C injection molding process.

In order to be able to put away the carrying case 10 in a preferably lockable storage cabinet when not in use, the support frame 16 is formed with a shoulder 41 on each of the to opposite long sides adjoining the front end with the holding bracket 18. These shoulders 41 respectively function as a simple form of a support with which the support frame 16 and thus the entire carrying case 10 can be easily and stably slid, for example, into a cabinet or a compartment on a corresponding guide rail. The shoulders 41 in the support frame 16 can in this context prevent the sides of the bag element 12 from rubbing against the inner walls of the storage cabinet or the like and thus becoming worn.

The carrying case 10 further includes a carrying strap 32. The carrying strap 32 is preferentially removably provided on the carrying case 10 so that the carrying case 10 can be optionally equipped with carrying straps 32 of different lengths depending on use. The carrying strap 32 is thereby fastened to the support frame 16 and the bag element 12 in such a way that it wraps around the closed narrow sides of the bag element 12 and thereby overlaps the connecting line between the two bag elements 12*a*, 12*b*.

As is indicated in FIG. 3, the cover layer of the multilayer bag elements 12*a*, 12*b* and the carrying strap 32 protect the edge of the board-like furniture element 20 when the carrying case 10 is hanging thereon. In this way, the harder support frame 16 of the carrying case 10 can be prevented from colliding with the furniture element 20.

Elastic (rubber) bands 34 are additionally wrapped around the bag element 12. A user can stow additional equipment (e.g. keyboard, notebook, etc.) between these elastic bands 34 and the outer side of the bag element 12 if needed.

As further accessories, the carrying case 10 can be optionally provided with an inside pocket 36 for holding smaller work items (e.g. writing instruments, etc.) or hanging file frames 38 or the like (see FIG. 2).

The invention claimed is:

1. A carrying case, comprising:

a bag element for accommodating items, said bag element having a position of use defining an upper edge region, an upper side and an access opening at said upper side;

a dimensionally stable support frame to which said upper edge region of said bag element is fixed in said position of use, rendering said access opening accessible through said support frame; and a dimensionally stable holding bracket formed in one-piece with said support frame and having a dimensionally stable first projection and a dimensionally stable second projection, said holding bracket permitting the carrying case to be hung from a board-shaped furniture element with said first projection contacting an upper side of the furniture element and said second projection contacting an underside of the furniture element for receiving an edge of the board-shaped furniture element between said first and second projections;

said first and second projections each being substantially straight and extending outward from said support frame in substantially identical directions;

said first and second projections extending substantially parallel to one another providing said holding bracket with an approximately C-shape in a side view; and said first and second projections having free ends facing away from said support frame and being spaced apart one from another.

2. The carrying case according to claim 1, wherein said first projection of said holding bracket has a contact side for making contact with the furniture element and a first soft component on said contact side.

3. The carrying case according to claim 1, wherein said second projection of said holding bracket has a contact side for making contact with the furniture element and a second soft component on said contact side.

4. The carrying case according to claim 1, wherein said support frame has one side at which said holding bracket is provided and two adjoining sides at which at least one respective shoulder is formed.

5. The carrying case according to claim 1, wherein said bag element is dimensionally stable.

6. The carrying case according to claim 1, wherein said bag element is assembled from two bag shells.

7. The carrying case according to claim 1, wherein said position of use defines a lower side of said bag element having at least one stand.

8. The carrying case according to claim 1, wherein said bag element has a multilayer construction.

9. The carrying case according to claim 1, which further comprises a carrying strap being fixedly or detachably fastened to at least one of said support frame or said bag element.

10. The carrying case according to claim 9, wherein said bag element is assembled from two bag shells defining a connection therebetween, and said carrying strap overlaps said connection.

11. The carrying case according to claim 1, wherein said second projection of said holding bracket extends outward from said support frame farther than said first projection.

12. The carrying case according to claim 1, wherein said support frame is made from a strong plastic material.

* * * * *